US010392846B2

(12) United States Patent
Sprague

(10) Patent No.: US 10,392,846 B2
(45) Date of Patent: Aug. 27, 2019

(54) SHOWER DOOR SYSTEM WITH GRAVITY HINGE

(71) Applicant: C.R. Laurence Co., Inc., Los Angeles, CA (US)

(72) Inventor: Gary Sprague, Los Angeles, CA (US)

(73) Assignee: C.R. LAURENCE CO., INC., Los Angeles, CA (US)

( * ) Notice: Subject to any disclaimer, the term of this patent is extended or adjusted under 35 U.S.C. 154(b) by 299 days.

(21) Appl. No.: 15/426,830

(22) Filed: Feb. 7, 2017

(65) Prior Publication Data

US 2017/0226787 A1 Aug. 10, 2017

Related U.S. Application Data

(60) Provisional application No. 62/293,202, filed on Feb. 9, 2016.

(51) Int. Cl.

| | |
|---|---|
| ***E05D 15/56*** | (2006.01) |
| ***E05F 1/06*** | (2006.01) |
| ***E05D 3/02*** | (2006.01) |
| ***E06B 1/70*** | (2006.01) |
| ***E05D 7/10*** | (2006.01) |
| ***E05F 1/12*** | (2006.01) |
| ***A47K 3/30*** | (2006.01) |
| ***E05D 5/02*** | (2006.01) |
| ***E05D 5/04*** | (2006.01) |
| *A47K 3/36* | (2006.01) |

(52) U.S. Cl.

CPC ..... *E05F 1/06* (2013.01); *A47K 3/30* (2013.01); *E05D 3/02* (2013.01); *E05D 5/0246* (2013.01); *E05D 5/04* (2013.01); *E05D 7/1044* (2013.01); *E05F 1/063* (2013.01); *E05F 1/1246* (2013.01); *E05F 1/1253* (2013.01); *E06B 1/70* (2013.01); *A47K 2003/367* (2013.01); *E05Y 2900/114* (2013.01); *E06B 2001/707* (2013.01)

(58) Field of Classification Search

CPC ..... E05D 7/06; E05F 1/04

USPC .... 49/236, 237, 238, 239; 16/309, 312, 313, 16/314, 315, 316, 317

See application file for complete search history.

(56) References Cited

U.S. PATENT DOCUMENTS 1,318,824 A * 10/1919 Alary ..... 16/315
1,386,621 A * 8/1921 Hughes ..... E05F 1/065 16/284
3,107,758 A * 10/1963 Benham ..... E05F 1/1223 16/284
3,113,649 A * 12/1963 Wargo ..... E05F 1/063 16/312
3,160,913 A * 12/1964 Carey ..... E05D 7/06 16/315

(Continued)

FOREIGN PATENT DOCUMENTS

EP 230486 A1 * 1/1986

*Primary Examiner* — Jerry E Redman

(74) *Attorney, Agent, or Firm* — Cislo & Thomas, LLP

(57) ABSTRACT

A shower door and hinge assembly comprising a glass shower door, a sloping sill, a sill angle adapter, upper and lower horizontal door frame rails, and upper and lower shower door hinges where the lower hinge is a gravity style hinge featuring a self-closing action, is presented. The hinges of the present invention shower door and hinge assembly attach only to horizontal edge surfaces of the glass door. The hinges do not attach to any vertical surface of the door.

15 Claims, 8 Drawing Sheets

(56) References Cited

U.S. PATENT DOCUMENTS 3,191,214 A * 6/1965 Protzman ..... E05D 7/0027 16/87 R
3,325,942 A * 6/1967 Bejarano ..... E05D 7/0423 16/245
3,378,881 A * 4/1968 Hentzi ..... E05F 1/063 16/312
3,398,487 A * 8/1968 Matyas ..... E05F 1/063 16/312
3,546,736 A * 12/1970 Booth ..... E05F 1/063 16/312
3,628,845 A * 12/1971 Grimm ..... E05F 1/063 16/312
3,648,327 A * 3/1972 Edeus ..... E05F 1/061 16/236
3,653,156 A * 4/1972 Horgan, Jr. ..... E06B 3/02 49/501
3,722,031 A * 3/1973 Bourgeois ..... E05F 1/063 16/317
3,828,394 A * 8/1974 Horgan, Jr. ..... E05D 5/0246 16/241
3,858,274 A * 1/1975 Burton ..... E05F 1/061 16/312
3,964,207 A * 6/1976 Peterson ..... E05D 7/081 49/388
4,090,274 A * 5/1978 Bourgeois ..... E05F 1/063 16/317
4,523,414 A * 6/1985 Horgan, Jr. ..... E05D 5/0246 49/388
4,956,954 A * 9/1990 Horgan, Jr. ..... E05D 5/0246 49/381
5,265,311 A * 11/1993 Gard ..... E05F 1/06 16/311
5,283,978 A * 2/1994 Horgan, Jr. ..... E05D 5/0246 49/388
5,500,984 A * 3/1996 Lee ..... E05F 1/063 16/309
5,613,276 A * 3/1997 Franz ..... A47K 3/36 16/229
5,867,869 A * 2/1999 Garrett ..... A47K 3/36 16/252
6,161,255 A * 12/2000 Garrett ..... A47K 3/36 16/284
6,643,898 B1 * 11/2003 Cameron ..... A47K 3/36 16/309
6,826,870 B2 * 12/2004 Chiang ..... E05D 5/0246 49/388
6,928,699 B2 * 8/2005 Sawa ..... E05F 3/20 16/303
6,990,772 B2 * 1/2006 Eckel ..... E05F 1/063 16/316
7,111,361 B2 * 9/2006 Li ..... H04M 1/0216 16/284
7,127,777 B2 * 10/2006 Chiang ..... E05D 5/0246 16/252
7,555,815 B2 * 7/2009 Tate, Jr. ..... E05D 3/022 16/221
8,432,677 B2 * 4/2013 Duan ..... G06F 1/1681 16/303
8,510,913 B2 * 8/2013 Kim ..... E05D 11/06 16/268
8,578,557 B2 * 11/2013 Yu ..... E05F 3/104 16/274
8,701,248 B2 * 4/2014 Dries ..... E05D 5/10 16/280
8,776,436 B2 * 7/2014 Miller ..... E05F 1/043 49/236
8,789,240 B2 * 7/2014 Bouwman ..... E05D 5/0246 16/252
9,687,087 B1 * 6/2017 Artwohl ..... A47F 3/0434
9,903,638 B2 * 2/2018 Dubina ..... E05D 7/00
2002/0116788 A1 * 8/2002 Pompei ..... E05F 1/063 16/315
2005/0011046 A1 * 1/2005 Dionysian ..... E05F 1/063 16/316
2007/0169413 A1 * 7/2007 Miller ..... E05F 1/065 49/236
2007/0193118 A1 * 8/2007 Miller ..... E05F 1/043 49/236
2010/0043293 A1 * 2/2010 Nicholson ..... A47F 3/0434 49/70

* cited by examiner

SHOWER DOOR SYSTEM WITH GRAVITY HINGE

CLAIM FOR PRIORITY

This application claims priority from U.S. Provisional Application Ser. No. 62/293,202 entitled "Shower Door System With Gravity Hinge," filed on Feb. 9, 2016, the contents of which are incorporated herein, in their entirety.

BACKGROUND OF THE INVENTION

Field of the Invention

The present invention relates generally to the art of shower door enclosures and more particularly to a shower door featuring a gravity hinge to provide the door with a self-closing action.

Background of the Invention

Bathroom design has achieved a significant level of importance in the overall appearance of a home. Architects and homeowners today are insisting that every detail of bathroom appearance be precise and decorative in nature. Unfortunately, when it comes to installing shower doors, available shower door binges are generally not in conformance with the otherwise highly decorative theme of the modern residential bathroom. Prior art shower door hinges are typically bulky, exposed mechanical devices that are decidedly not decorative its nature.

Most shower doors presently available are constructed of metal and glass and are of the swinging door type. Such doors usually are affixed to the shower enclosure at the pivoted edge of the door using piano style hinges which often extend the full height of the door. Prior art hinges typically connect the metal frame of the door to the enclosure jamb and are bolted to the jamb in several places as is required to adequately support the weight of the door. In a typical installation, the free edge of the door swings against a vertical metal strike plate which is bolted to the door jamb on that side of the enclosure. The strike plate serve as a positive stop to the door's travel. A spring biased latch is also often used in conjunction with the strike plate to keep the door in the closed position.

Traditional methods of affixing a shower door to an enclosure as described above have proven to be undesirable in modern high-end shower enclosures. Modern high-end shower enclosures typically feature a glass door set into a glass wall. In this style of installation, it is desirable to polish the vertical edges of the glass door and leave the vertical edges unframed to create the appearance of an unbroken glass wall.

Piano style hinges and most other prior art shower door hinges are poorly suited to the glass wall style of shower enclosure because the glass door lacks vertical frame rails and the glass wall lacks a jamb structure. Thus, no suitable structure is present within which to install the hinges on the pivoted edge of the door and the strike plate on the free edge of the door. While it may be possible to install the hinges and strike plate directly to the glass door and associated glass wall structure, any such installation would be unsightly and unacceptable to both architects and consumers.

What is needed therefore, is an alternative to the traditional piano style door hinge specifically designed to work with glass doors installed in glass wall shower enclosures. Any such hinge system should be sufficiently compact so that it may be hidden within relatively low profile bottom and top rails attached to the glass shower door to provide for an unbroken glass wall appearance. Ideally, the hinges would not attach to any part of the vertical surface of the glass door. It would further be desirable that the hinges incorporate a self-closing feature eliminate the need for a strike plate and latch on the free end of the door.

SUMMARY OF THE INVENTION

The present invention solves the problems of the prior art by providing a glass shower door, a sloping sill, a sill angle adapter, upper and lower horizontal door frame rails, and a shower door hinge assembly where the hinges include a self-closing feature and attach only to horizontal edge surfaces of the glass door, i.e. the hinges do not attach to any vertical surface of the door. The hinges of the present invention comprise a lower hinge with self-closing provisions which is used in conjunction with a pivot style upper hinge. The lower and upper hinges are sufficiently compact such that the upper hinge may be hidden within the upper horizontal rail of the door and the header of the shower enclosure and the lower hinge may be hidden within the lower horizontal rail of the door and the sill of the shower enclosure.

The gravity style lower hinge of the invention includes lower or fixed portion and an upper or rotating portion where the fixed portion mounts to the sill of the shower enclosure and the rotating portion mounts to a lower horizontal rail attached to the lower horizontal edge of the glass door. The fixed portion of the lower hinge includes a cylindrical receptacle for receipt of a pintle or pin fixed to the shower door. Arranged radially about an opening of the receptacle and spaced angularly from a longitudinal axis of the fixed half of the lower hinge are a pair of mutually opposed raised surfaces and a pair of mutually opposed grooves or low surfaces. Joining the each raised surface and each groove or low surface is an interconnecting ramp. The radial centers of the raised surfaces, grooves and interconnecting ramps are measured angularly from a longitudinal axis of the fixed portion of the lower hinge. The angular position of these futures are as follows: The raised surfaces are located at 0° and 180°. The grooves are located at 90° and 270°. The ramps are located at 45°, 135°, 225° and 315°.

The rotating portion of the lower hinge contains essentially the same features as the fixed portion, except that the features are clocked 90 degrees from those of the fixed portion. In particular, the rotating portion of the lower hinge includes raised surfaces, grooves, and ramps which interconnect the raised surfaces and the grooves. The angular position of these features on the rotating portion of the lower hinge, with respect to a longitudinal axis of the rotating portion of the lower hinge, are as follows: The raised surfaces are located at 90° and 270°. The grooves are located at 0° and 180°. The camming ramps are located at 45°, 135°, 225° and 315°.

The fixed and rotating portions of the lower hinge are configured to be engaged when installed. At all times, the fixed portion of the lower hinge remains in a fixed position attached to the sill, whereas the rotating portion of the lower hinge is attached to the shower door and rotates as the door is opened or closed. The grooves define the self-centering or closed position of the door. With the door is at rest in the closed position, the raised surfaces of the rotating portion of the lower hinge rest in mating grooves in the fixed portion of the lower hinge. Likewise, the raised surfaces of the fixed portion of the lower hinge will rest in mating grooves of the rotating portion of the hinge. When the door is pushed outwardly, the raised surfaces of the rotating portion of the lower hinge ride upwardly along the ramps of the fixed portion of the hinge. When the raised surfaces of the rotating portion are positioned on the ramps of the fixed portion, the weight of the door will bias the raised surfaces towards the self-centered or closed position in the grooves. Thus, if the door is released, the door will close of its own accord.

Continued pushing of the shower door outwardly, will cause the raised surfaces of the rotating portion of the hinge to continue to ride up the ramps on the fixed portion of the hinge until the raised surfaces of the rotating portion of the hinge rest upon the raised surfaces of the fixed portion of the hinge. Once the raised surfaces of the rotating portion of the hinge rest upon the raised surfaces of the fixed portion of the hinge, the door will then open freely, i.e. the bias due to the weight of the door is then removed and the door will not close of its own accord. If the open door is then pushed inwardly, once the raised surfaces of the rotating portion slide off those of the fixed portion and begin descending the ramps of the fixed portion, the door will again be biased to the self-centered or closed position. The arc width of the ramps and the raised surfaces controls the range of motion for which the door will be biased to a closed position or allowed to travel freely.

In at least the region spanned by the shower door, the sill of the shower door and hinge assembly of the present invention is configured to slope downwardly towards the drain (inwardly) of the shower enclosure. The downward angle of the sill assists in preventing water from escaping the shower enclosure via the opening for the shower door. To allow for installation of the lower door hinge and the lower horizontal frame rail on the shower door, a sill adapter is provided to create a level surface. On the portion of the lower horizontal frame rail adjacent the lower door hinge, a sweep seal is provided to seal the gap between the lower frame rail of the door and the sill or sill angle adapter. The above and other advantages of the shower door system of the present invention will be described in more detail below.

DETAILED DESCRIPTION OF THE PREFERRED EMBODIMENTS

Figure 1:
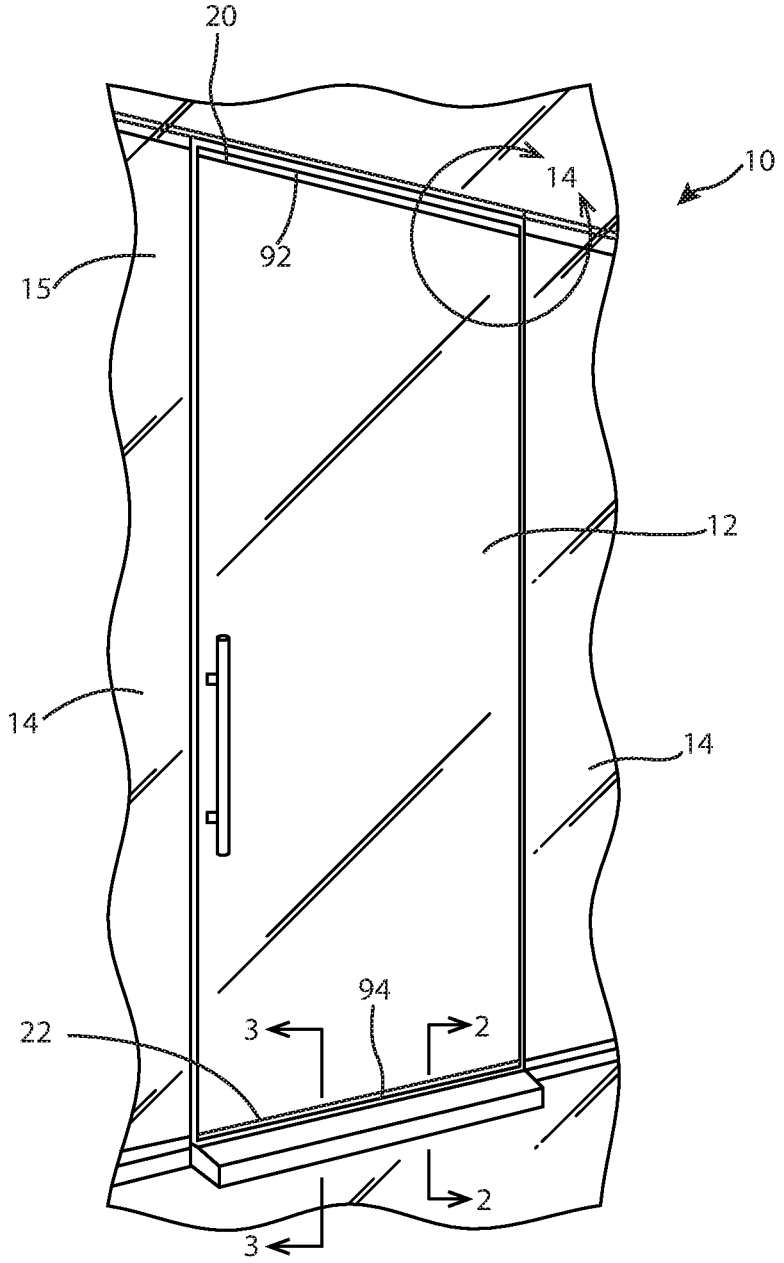
FIG. 1 is a schematic representation of a shower door and hinge assembly of the present invention installed in a shower enclosure.

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

With reference to FIGS. 1 through 5, the shower door and hinge assembly of the present invention 10 typically comprises a glass shower door 12 disposed adjacent to glass walls 14 of a shower enclosure 15. The shower door and hinge assembly 10 further includes a sloping sill 16, a sill angle adapter 18, upper and lower horizontal door frame rails 20 and 22, an upper shower door hinge assembly 26 (see FIG. 14) which is a pivot style hinge and a lower shower door hinge assembly 24 (see FIGS. 2-11), referred to as a gravity hinge.

With reference to FIGS. 2-11, the gravity style lower hinge assembly 24 includes a fixed hinge portion 28 and a rotating hinge portion 30 where the fixed hinge portion 28 mounts to the sill 16 of the shower enclosure via the sill angle adapter 18 and the rotating hinge portion 30 mounts to the lower horizontal rail 22 attached to a lower horizontal edge of the glass door 12. The fixed portion 28 of the lower hinge 24 includes a cylindrical receptacle 32 for receipt of a pivot pin 34 extending from the glass door 12.

Arranged radially about an opening 36 of the receptacle 32 of the fixed portion 28 of the lower hinge 24 and spaced angularly from a longitudinal axis 38 of the fixed portion 28 are two pairs of mutually opposed inclined surfaces referred to as ramps or camming ramps 40, a pair of raised surfaces 42 and two grooves 44. The radial centers of the ramps 40, raised surfaces 42 and grooves 44, measured angularly from a longitudinal axis 38 of the fixed portion 28 of the lower hinge 24, are as follows: The raised surfaces 42 are located at 0° and 180°. The grooves 44 are located at 90° and 270°. The two pairs of mutually opposed camming ramps 40 are located at 45°, 135°, 225° and 315°. The arc width 41 of the camming ramps 40 controls the range of motion through which the shower door 12 will be biased to a closed position, while the arc width 43 of the raised surfaces 42 controls the range of motion for which the shower door 12 will be able to travel freely.

The fixed portion 28 of the lower hinge 24 also features a water management dam 46, which assists in preventing water from escaping the shower enclosure. Also included in the fixed portion 28 are a pair of aced apart alignment holes 48 which are configured as elongated slots. The alignment holes 48 allow for the fixed portion 28 to be attached to the sill 16 of the shower enclosure mechanical fasteners typically screws.

Figure 2:
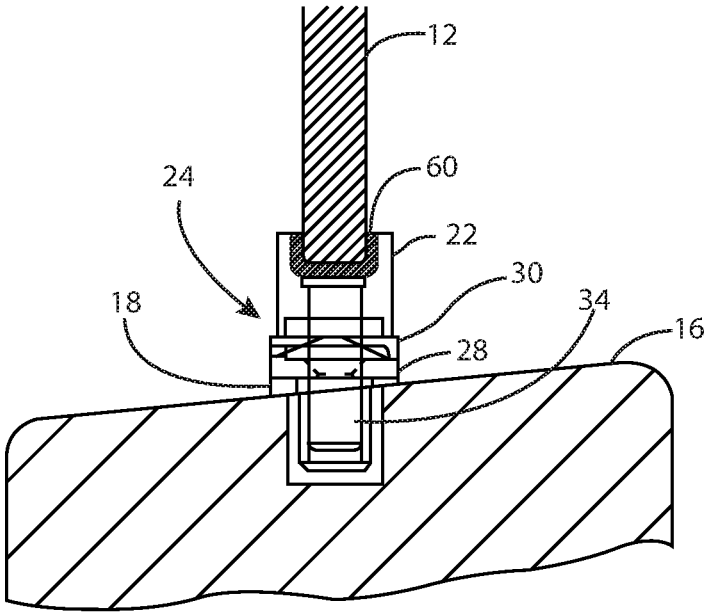
FIG. 2 is a cross-sectional view taken along the line 2-2 of FIG. 1, showing details of the lower hinge of the shower door and hinge assembly of the present invention.
Figure 3:
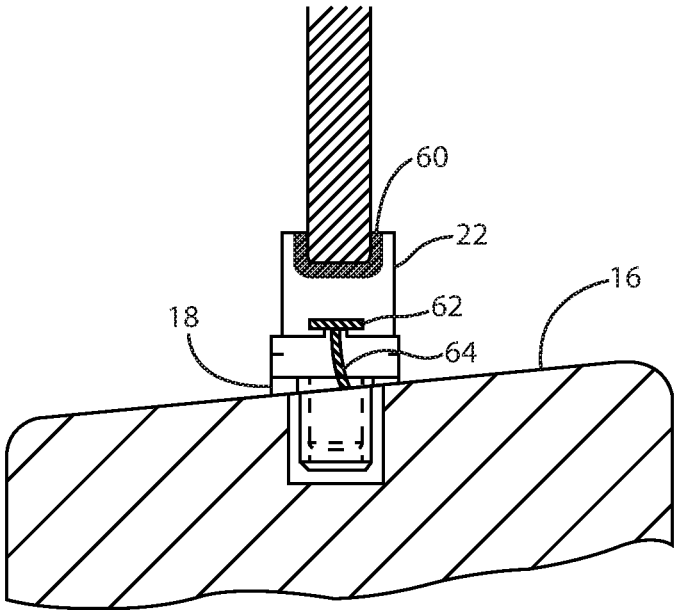
FIG. 3 is a cross-sectional view taken along the line 3-3 of FIG. 1, showing details of the lower horizontal rail and sweep seal assembly of the shower door and hinge assembly of the present invention.
Figure 4:
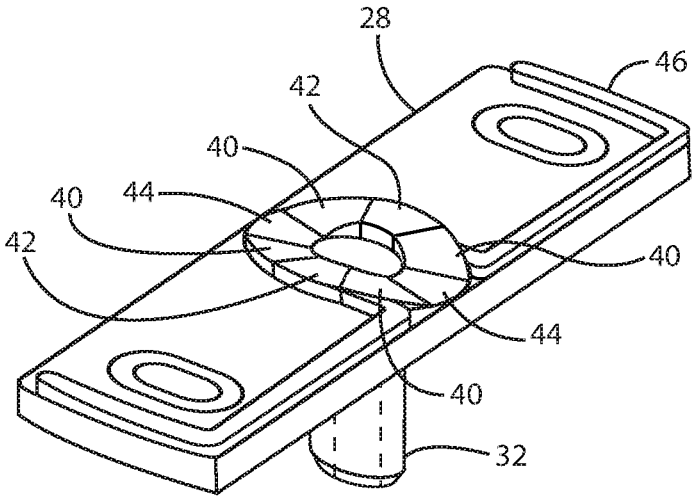
FIG. 4 is a perspective view of a fixed portion of the lower hinge of the shower door and hinge assembly of the present invention.
Figure 5:
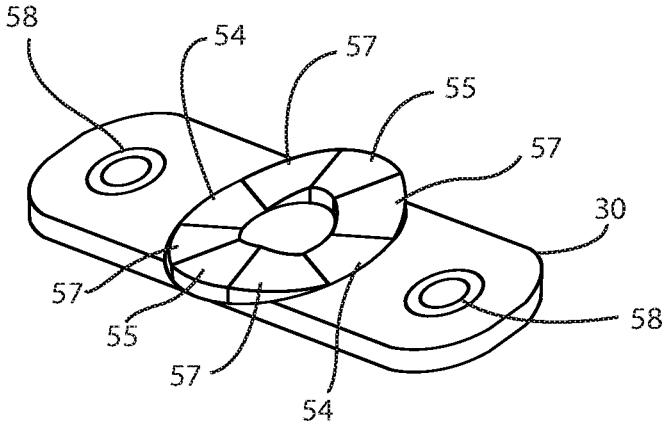
FIG. 5 is a perspective view of a rotating portion of the lower hinge of the shower door and hinge assembly of the present invention.
Figure 6:
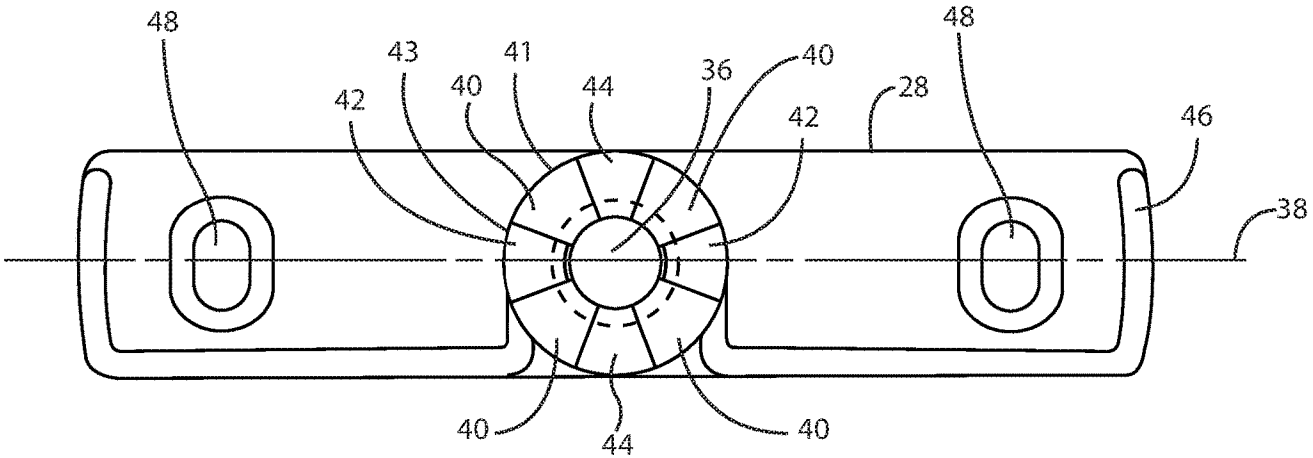
FIG. 6 is a top view of the fixed portion of the lower hinge of the shower door and hinge assembly of the present invention.
Figure 8:
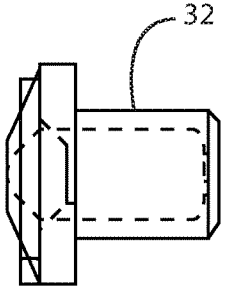
FIG. 8 is an end view of the fixed portion of the lower hinge of the shower door and hinge assembly of the present invention.
Figure 7:
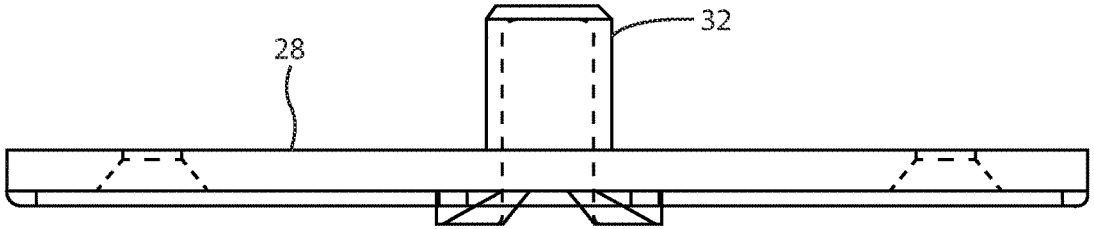
FIG. 7 is a side view of the fixed portion of the lower hinge of the shower door and hinge assembly of the present invention.
Figure 9:
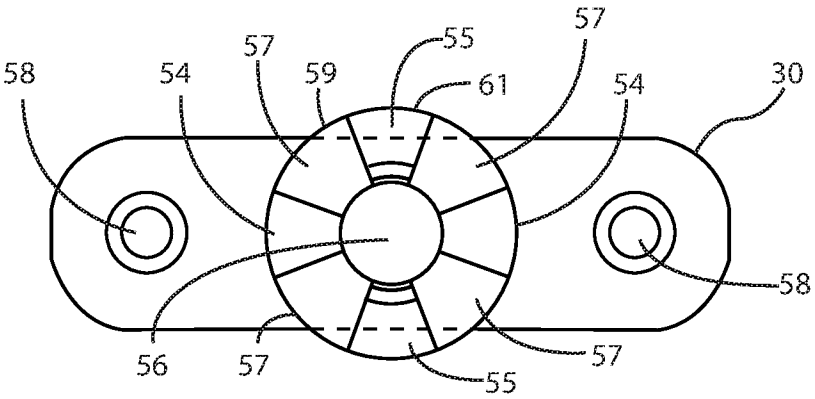
FIG. 9 is a top view of the rotating portion of the lower hinge of the shower door and hinge assembly of the present invention.
Figure 11:
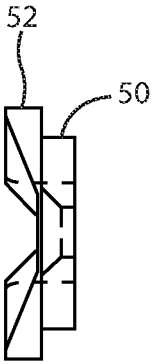
FIG. 11 is an end view of the rotating portion of the lower hinge of the shower door and hinge assembly of the present invention.
Figure 10:
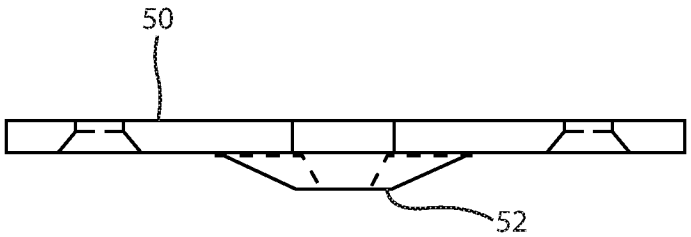
FIG. 10 is a side view of the rotating portion of the lower hinge of the shower door and hinge assembly of the present invention.
Figure 13:
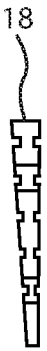
FIG. 13 is an end view of a sill angle adapter of the shower door and hinge assembly of the present invention.
Figure 12:
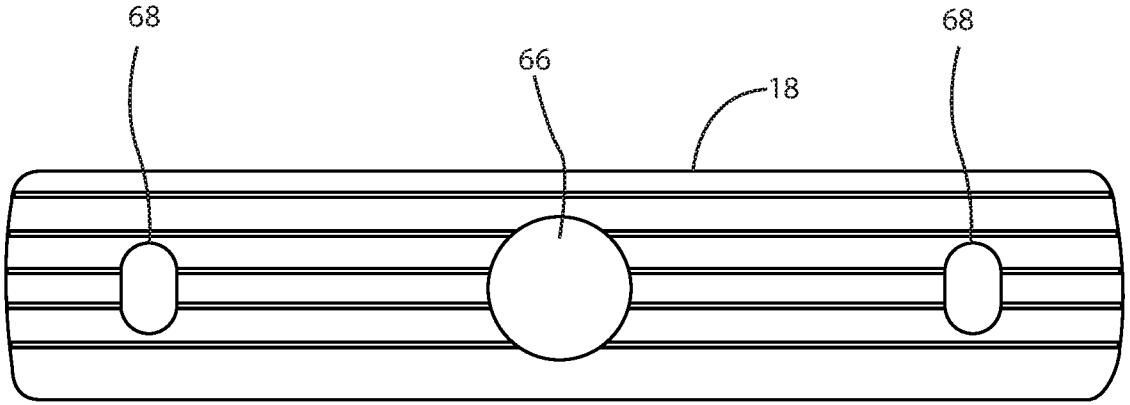
FIG. 12 is a top view of a sill angle adapter of the shower door and hinge assembly of the present invention.

With reference to FIGS. 2 and 12-13, disposed between the fixed portion 28 of the lower hinge 24 and the sill 16 is the sill angle adapter 18. The sill angle adapter 18 includes a through-hole 66 for receipt of the pivot pin 34, as well as mounting slots 68 which allow the sill adapter 18 to be attached to the sill 16, typically via mechanical fasteners such as screws.

With reference to FIGS. 2, 5 and 9-11, the rotating portion 30 of the lower hinge 24 includes a generally rectangular section 50 having rounded corners and a generally cylindrical upper section 52 formed integrally with the lower section 50. The generally cylindrical upper section 52 includes mutually opposed raised surfaces 55, low surfaces or grooves 54; and ramps or camming ramps 57. The arc width 59 of the camming ramps 57 and the arc width 61 of the raised surfaces 55, in conjunction with those of the fixed portion 28 of the lower hinge 24, controls the range of motion through which the shower door 12 will be biased to a closed position or will be able to travel freely in an open position.

The rotating portion 30 of the lower hinge 24 also includes a cylindrical opening 56 through which the pivot pin 34 (see FIG. 2) passes. Also included are attachment holes 58, which allow the rotating portion 30 to attach to the lower horizontal rail 20 (shown in FIG. 1) of the glass door 12.

With reference to FIGS. 1-2, and 4-8, the lower hinge 24 is configured such that the pivot pin 34 is rigidly attached to the lower horizontal rail 20 which itself is affixed to the glass door 12. The rotating portion 30 of the lower hinge 24 is attached to the lower horizontal rail 20 via mechanical fasteners (typically screws) (not shown) and is positioned such that the pivot pin 34 protrudes from the cylindrical opening 56 of the rotating portion 30. Likewise, the fixed portion 28 of the lower hinge 24 is attached to the sill 16 via the sill adapter 18 by means of mechanical fasteners, also, typically screws (not shown). The shower door 12 is installed in the shower enclosure by mating the fixed and rotating portions 28 and 30. The fixed and rotating portions 28 and 30 are mated by positioning the pivot pin 34, which protrudes from the cylindrical opening 56 of the rotating portion 30 of the lower hinge 24, into the cylindrical receptacle 32 of the fixed portion 28.

Figure 14:
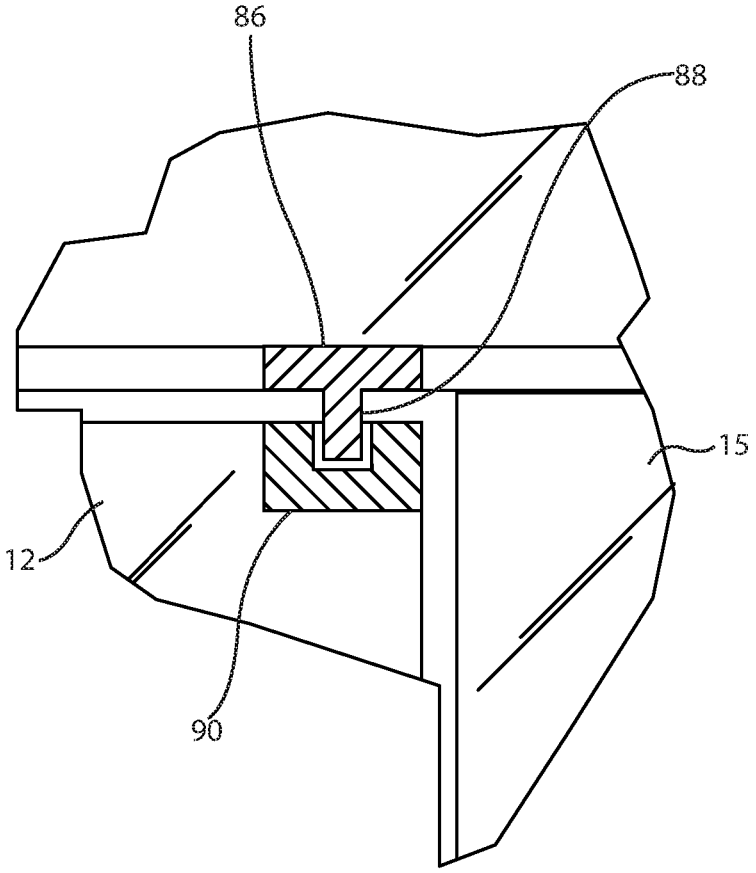
FIG. 14 is a schematic view of the upper hinge assembly of the shower door and hinge assembly of the present invention.

With reference to FIGS. 1 and 14, during installation of the shower door 12 into the shower enclosure 15, the components of the upper hinge 26 between the door and the shower enclosure would also be installed. The upper hinge 26 is shown schematically in FIG. 14. The upper hinge 26 comprises an upper hinge block or upper portion 86, a pivot pin 88 and a lower hinge block or lower portion 90. The lower hinge block 90 would typically be mounted concealed in the upper horizontal rail 20. The upper hinge block 86 would typically be mounted in a header of the shower enclosure 15.

With reference to FIGS. 1-11, the fixed portion 28 and rotating portion 30 of the lower hinge 24 are configured to be engaged when installed. At all times, the fixed portion 28 of the lower hinge 24 remains in a fixed position, whereas the rotating portion 30 of the lower hinge 24 rotates as the shower door 12 is opened or closed. The grooves 44 in the fixed portion 28 and the grooves 54 in the rotating portion 30, define the self-centered or closed position of the door 12 when the grooves (44, 54) are engaged with the raised portions 42 of the fixed portion 28 and the raised portions 55 of the rotating portion 30.

In other words, when the shower door 12 is in the closed position, the grooves 54 of the rotating portion 30 of the lower hinge 24 located at 0° and 180° will be engaged with the raised surfaces 42 of the fixed portion 28 of the lower hinge 24 which are also located at 0° and 180°. Similarly, the raised surfaces 55 of the rotating portion 30 of the lower hinge 24 located at 90° and 270° are engaged with the grooves 44 of the fixed portion 28 of the lower hinge 24 also located at 90° and 270°.

With reference to FIGS. 1-11, when the shower door 12 is installed in the shower enclosure 15, the weight of the door 12 is transmitted via the raised surfaces 55 of the rotating portion 30 of the lower 24 to either the ramps 40, raised surfaces 42 or grooves 44 of the fixed portion 28 of the lower hinge 24, depending upon the position of the door 12. The upper portion 30 and lower portion 28 of the lower hinge 24, when engaged and bearing the weight of the door act as follows.

When the raised portions 55 of the rotating portion 30 of the lower hinge 24 are at rest in the grooves 44 of the fixed portion 28, the shower door 12 is in the closed or self-centered position. When the shower door 12 is pushed outwardly, the raised surfaces 55 of the rotating portion 30 of lower hinge 24 ride upwardly along the camming ramps 40 of the fixed portion 28 of the lower hinge 24. When the raised surfaces 55 of the rotating portion 30 are positioned on the camming ramps 40 of the fixed portion 28, the weight of the door 12 biases the raised surfaces 55 towards the grooves 44. Thus, if the door 12 is released when the raised surfaces 55 are riding upon the camming ramps 40, the door 12 will close of its own accord.

Continued pushing of the door 12 outwardly, will cause the raised surfaces 55 of the rotating portion 30 of the lower hinge 24 to continue to ride up the camming ramps 40 of the fixed portion 28 until they reach the raised surfaces 42 of the fixed portion 28. Once the raised surfaces 55 of the rotating portion 30 of the lower hinge 24 are on the raised surfaces 42 of the fixed portion 28 of the lower hinge 24, the door 12 will then open freely, i.e. the bias due to the weight of the door is then removed and the door will not close of its own accord.

If the open door is then pushed close, once the raised surfaces 55 of the rotating portion 30 traverse the raised surfaces 42 of the fixed portion 28 and begin descending the camming ramps 40 of the fixed portion 28, the door 12 will again be biased to the self-centered or closed position and the raised surfaces 55 of the rotating portion will again come to rest in the grooves 44 of the fixed portion 28.

Other features of the shower door and hinge assembly of the present invention 10, include the sill 16 which is configured to slope downwardly towards the drain of the shower enclosure. The downward angle of the sill 16 assists in preventing water from escaping the shower enclosure via the opening for the shower door. To allow for installation of the fixed portion 28 of the lower door hinge 24 on the sill 16, the sill adapter 18 is provided to create a level surface.

The lower and upper horizontal door frame rails 20 and 22 of shower door and hinge assembly 10, are extrusions which feature a generally u-shaped channel section 60 and a sweep seal retaining section 62 for retention of a sweep seal 64. The sweep seal 64 is provided to seal a gap between the shower door 12 and the sill 16.

The u-shaped channel sections 60 of the lower and upper horizontal frame rails 20 and 22 are configured to receive the lower and upper horizontal edges of the glass door 12, respectively. The lower and upper horizontal frame rails 20 and 22 are bonded to lower 94 and upper 92 horizontal edges of the glass door 12 via structural adhesive placed within u-shaped channels 60.

The component parts of the shower door and binge assembly of the present invention 10 may be made from a number of materials. In the exemplary embodiment, the rotating portion 30 and fixed portion 28 of the lower hinge 24, as well as the still angle adapter 18, are made from a structural grade thermoplastic material having excellent dimensional stability. Suitable thermoplastic materials such as polyoxymethylene ("POM") materials are widely available from a number of manufacturers under the trade names Delrin, Celcon, Ramtal and Duracon, among others. In the exemplary embodiment, the lower and upper horizontal frame rails 20 and 22 are made from aluminum and will typically feature stainless steel decorative cladding. These components may also be made from other extrudable metallic materials.

Figure 15:
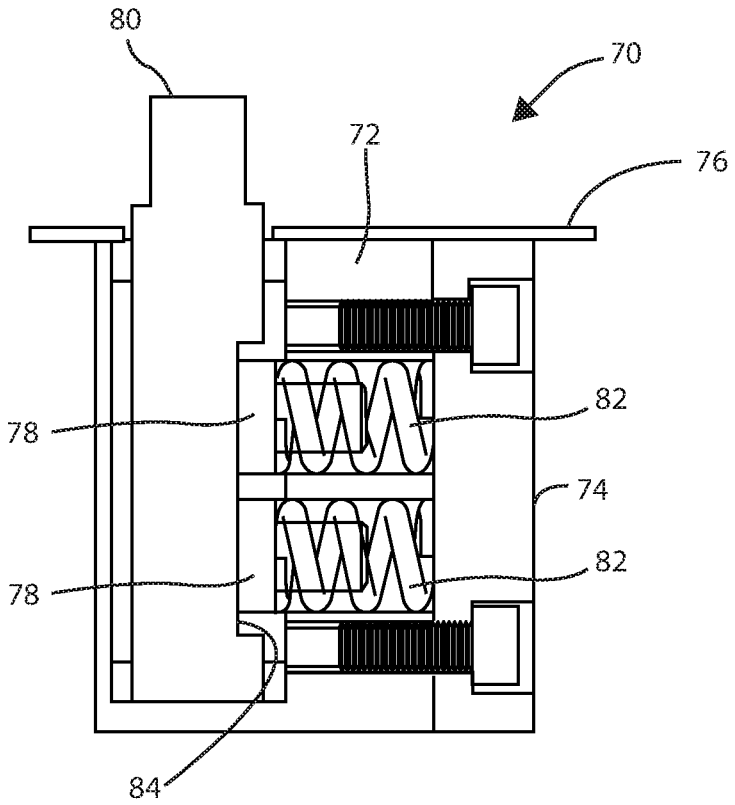
FIG. 15 is a side view of alternative embodiment of a lower hinge suitable for use with heavy shower doors.
Figure 16:
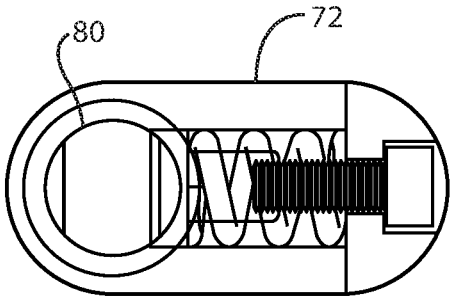
FIG. 16 is a side view of an alternative embodiment of a lower hinge suitable for use with heavy shower doors.

With reference to FIGS. 15 and 16, a heavy door closing device 70, which may be used with the shower door and hinge assembly of the present invention, is disclosed. The heavy door closing device 70 comprises a housing 72 end cap 74, cover plate 76, a spindle/cam 80, a cam follower 78 and biasing springs 82. The spindle/cam 80 is configured with a flat surface 84 which is engagable by the cam follower 78 to establish a closed or at rest position. When the cam follower 78 is engaged with the flat surface 84 of the spindle/cam 80, the cam follower 78 is biased against the flat surface 84 by the biasing springs 82. The force provided by the biasing springs 82 tends to keep a door 12 equipped with heavy closing device 70 secured in the closed position.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A shower door and hinge assembly comprising:

a shower door having a weight and an upper horizontal edge and a lower horizontal edge;

an upper horizontal rail attached to the upper horizontal edge of the shower door;

a lower horizontal rail attached to the lower horizontal edge of the shower door;

an upper hinge, the upper hinge comprising an upper portion and a lower portion, wherein the upper portion of the upper hinge and lower portion of the upper hinge are pivotally connected;

a lower hinge; the lower hinge having a fixed portion and a rotating portion, wherein the fixed portion of the lower hinge and the rotating portion of the lower hinge are pivotally connected;

wherein, the fixed portion of the lower hinge includes raised surfaces disposed about a circular hole and located at 0° and 180° with respect to a longitudinal axis of the fixed portion of the lower hinge and includes grooves disposed about the circular hole and located at 45° and 270° with respect to the longitudinal axis of the fixed portion of the lower hinge, wherein ramps interconnect the raised surfaces with the grooves;

wherein, the rotating portion of the lower hinge includes raised surfaces disposed about a circular hole and located at 90° and 27° with respect to a longitudinal axis of the rotating portion of the lower hinge;

wherein, the fixed portion of the lower hinge and the rotating portion of the lower hinge are engageable;

wherein, engagement of the raised surfaces of the rotating portion of the lower hinge with the grooves of the fixed portion of the lower hinge biases the glass door to a closed position, wherein outward movement of the glass door causes the raised surfaces of the rotating portion of the lower hinge to disengage from the grooves of the fixed portion of the lower hinge and travel upwardly along the ramps of the fixed portion of the lower hinge until the raised surfaces of the rotating portion of the upper hinge contact and travel along the raised surfaces of the fixed portion of the lower hinge, whereby the door is in an open position; and wherein, inward movement of the door from the open position causes the raised portions of the rotating portion of the lower hinge to engage the ramps of fixed portion of the lower hinge wherein upon engagement, the weight of the glass door causes the raised surfaces of rotating portion of lower hinge to travel down the ramps of the fixed portion of the lower hinge and engage the grooves in the fixed portion of the lower hinge, whereby the door is biased in a closed position;

wherein the fixed portion of the lower hinge is attached to a sill; and wherein the sill has a top surface angled inwardly towards an interior of a shower enclosure wherein the angled top surface of the sill assists in preventing water release exterior of the shower enclosure.

2. The shower door and hinge assembly of claim 1, wherein the lower portion of the upper hinge is concealed within the upper horizontal rail.

3. The shower door and hinge assembly of claim 1, wherein the rotating portion of the lower hinge is concealed within the lower horizontal rail.

4. The shower door and hinge assembly of claim 1, wherein a sill angle adapter is disposed between the sill and the fixed portion of the lower hinge.

5. The shower door and hinge assembly of claim 1, wherein the lower horizontal rail includes a sweep seal, the sweep seal extending downwardly from a bottom surface of the lower horizontal rail and engaging the angled top surface of the sill, wherein the sweep seal assists in preventing water release exterior to the shower enclosure.

6. The shower door and hinge assembly of claim 1, wherein the fixed portion of the lower hinge includes a water management dam, wherein the water management dam assists in preventing water release exterior to a shower enclosure.

7. A shower door and hinge assembly comprising:

a shower door having a weight and an upper horizontal edge and a lower horizontal edge;

an upper horizontal rail attached to the upper horizontal edge of the shower door;

a lower horizontal rail attached to the lower horizontal edge of the shower door;

an upper hinge, the upper hinge comprising an upper portion and a lower portion, wherein the upper portion of the upper hinge and lower portion of the upper hinge are pivotally connected;

a lower hinge; the lower hinge having a fixed portion and a rotating portion, wherein the fixed portion of the lower hinge and the rotating portion of the upper hinge are pivotally connected; and means located within the lower hinge for biasing the door to a closed position;

wherein the fixed portion of the lower hinge is attached to a sill; and wherein the sill has a top surface angled inwardly towards an interior of a shower enclosure wherein the angled top surface of the sill assists in preventing water release exterior of the shower enclosure.

8. The shower door and hinge assembly of claim 7, wherein the means for biasing the shower door in a closed position comprises:

a raised surface disposed upon the rotating portion of the lower hinge and a raised surface and a groove disposed upon the fixed portion of the lower hinge, wherein a ramp interconnects the raised surface and the groove of the fixed portion of the lower hinge;

wherein, upon engagement of the raised surface of the rotating portion of the lower hinge with the groove of the fixed portion of the lower hinge, the shower door is biased in a closed position;

wherein outward movement of the shower door causes the raised surface of the rotating portion of the lower hinge to disengage from the groove of the fixed portion of the lower hinge and travel upwardly along the ramp of the fixed portion of the lower hinge until the raised surface of the rotating portion of the upper hinge contacts and travels along the raised surface of the fixed portion of the lower hinge, whereby the shower door is in an open position; and wherein, inward movement of the shower door from the open position causes the raised surface of the rotating portion of the lower hinge to engage the ramp of fixed portion of the lower hinge wherein upon engagement, the weight of the glass door causes the raised surface of rotating portion of lower hinge to travel down the ramp of the fixed portion of the lower hinge and engage the groove in the fixed portion of the lower hinge, whereby the glass door is biased to a closed position.

9. The shower door and hinge assembly of claim 8, wherein the raised surface and the groove of the fixed portion of the lower hinge are disposed about a circular hole.

10. The shower door and hinge assembly of claim 8, wherein the raised surface of the rotating portion of the lower hinge is disposed about a circular hole.

11. The shower door and hinge assembly of claim 7, wherein the lower portion of the upper hinge is concealed within the upper horizontal rail.

12. The shower door and hinge assembly of claim 7, wherein the rotating portion of the lower hinge is concealed within the lower horizontal rail.

13. The shower door and hinge assembly of claim 7, wherein a sill angle adapter is disposed between the sill and the fixed portion of the lower hinge.

14. The shower door and hinge assembly of claim 7, wherein the lower horizontal rail includes a sweep seal, the sweep seal extending downwardly from a bottom surface of the lower horizontal rail and engaging the angled top surface of the sill, wherein the sweep seal assists in preventing water release exterior to the shower enclosure.

15. The shower door and hinge assembly of claim 7, wherein the fixed portion of the lower hinge includes a water management dam, wherein the water management dam assists in preventing water release exterior to a shower enclosure.

* * * * *